US006142344A

United States Patent [19]

Kai

[11] Patent Number: 6,142,344

[45] Date of Patent: Nov. 7, 2000

[54] HOUSING AND SPOUT

[76] Inventor: Shigeo Kai, 8-4-12 Seijo, Setagaya-ku, Tokyo, Japan

[21] Appl. No.: 09/362,699

[22] Filed: Jul. 29, 1999

[30] Foreign Application Priority Data

| | | | |
|---|---|---|---|
| Jul. 29, 1998 | [JP] | Japan | 10-247697 |
| Aug. 14, 1998 | [JP] | Japan | 10-265634 |
| Jun. 14, 1999 | [JP] | Japan | 11-166766 |

[51] Int. Cl.[7] ..... B67D 3/00

[52] U.S. Cl. ..... 222/183; 222/105

[58] Field of Search ..... 222/92, 93, 105, 222/107, 173, 183

[56] References Cited

U.S. PATENT DOCUMENTS

| | | | |
|---|---|---|---|
| 3,191,810 | 6/1965 | Johnston | 222/183 |
| 3,310,830 | 3/1967 | Gattone | 222/183 |
| 3,325,058 | 6/1967 | West, Jr. | 222/183 |
| 3,358,885 | 12/1967 | Flowers | 222/183 |
| 5,096,092 | 3/1992 | Devine | 222/105 |
| 5,474,212 | 12/1995 | Ichikawa et al. | 222/105 |
| 5,730,327 | 3/1998 | Stern | 222/105 |
| 5,967,322 | 10/1999 | Apps et al. | 222/183 |

*Primary Examiner*—J. Casimer Jacyna

*Attorney, Agent, or Firm*—Jacobson, Price, Holman & Stern, PLLC

[57] ABSTRACT

A package body 4, is provided with a spout 3 which is welded to an inner surface of a mouth portion of the body 4. The spout 3 has an outer periphery of a welding part 13 having a curved outer surface of a boat shape in a plan view at a seat 8, and the outer periphery of the welding part 13 is welded to the inner surface of the mouth portion. The spout 3 includes a projected piece 12 at an outer periphery above the seat 8. The package body 4 is accommodated within a housing provided with a casing 1 openable about a hinge 2. The body 4 is arranged within the casing 1 in an opened state, with the spout 3 being directed upwardly, and then the casing 1 is closed to accommodate the package body 4. The spout 3 is fixed by a fixture 5 which is dividable into two halves with a center hole. This hole has a groove 20 for fixing the projected piece 12 of the spout 3 from the outside in the combined state of the spout fixture 5, and with a curved surface 21 for fixing the periphery 13 of the spout 3. The spout fixture 5 is provided with projecting rows 18 at an outside portion which is fixed to the supporting hole 19. These projecting rows 18 are fitted into concave row grooves 23 formed in the inner wall of an opening portion 22 defined at the upper portion of the casing 1, and by closing the casing 1 the package body 4 is accommodated within the casing 1 and the spout 3 is fixed.

2 Claims, 8 Drawing Sheets

HOUSING AND SPOUT

TECHNICAL FIELD

The present invention relates to a housing for accommodating therein a package body having a spout, and the spout to be attached to the package body.

BACKGROUND ART

As containers such as for mineral water and soft drink which are commercially available, there is used one made of hard synthetic resin such as polyethylene terephthalate (PET) having a volume of about 2 liters. These containers are fabricated by blow molding and called "PET bottle". However, this type of containers are problematic from an environmental viewpoint, since they are used as an alternative of a water bottle such as in hiking and discarded as they are to fields and mountains.

Those used PET bottles can not be naturally decomposed, even when they are buried as wastes into the ground.

As a countermeasure for such a problem, it has recently become common to use, instead of PET bottle, such a combination as shown in FIGS. 6 through 8, in which a spout 32 is attached to a bag-like package body 31 made of soft synthetic resin such as polyethylene, the package body 31 is accommodated in a housing 33 made of a hard synthetic resin, and the combination is used as a container for drinking water and other soft drinks, in lieu of PET bottle. According to this housing 33, when the filler within the package body 31 has been exhausted, the filler is refilled, or the exhausted and waste package body 31 is discarded and a new package body 31 is instead accommodated into the housing 33 to thereby use the combination as PET bottle again. Further, the package body 31, which is softer than a PET bottle, has a lower shape holdability, and is fragile to an external force, can be accommodated into the housing 33 so as to hold the shape of body 31, thereby facilitating the handling of the combination and providing strength against an external force.

Further, the housing 33 has a size and shape substantially identical with a PET bottle, is of a cylindrical shape made of hard synthetic resin such as polypropylene, has its upper half divided into two openable sub-halves, and is capable of removably receiving therein the package body 31 attached with the spout 32.

As depicted by dotted lines in FIG. 7, the spout 32 is formed with a cylindrical port, and thereunder has a seat 36 (see FIG. 8). Threadable onto an entrance opening 35 at the upper portion of the spout 32 is a cap 34 for establishing a structure capable of sealing the interior of the package body 31.

Substantially at the vertically central portion of the cylindrical spout 32, there is provided a plan-viewedly polygonal projection 37 integrally with the spout 32, and at the intermediate portion of the projection 37 and seat 36, there is further provided a similar plan-viewedly polygonal lower projection 38 having a slightly smaller size (see FIG. 8). Welded onto a side surface of the seat 36 by means of heat seal 41 is the package body 31 made of soft synthetic resin such as polyethylene, thereby enabling a filler such as drinking water and soft drink to be filled within the package body 31 integrated with the spout 32.

Provided at both sides of the top portion of the housing 33 are projecting rows 40 aimed at serving as a guide for fixedly fitting the spout 32 having a structure noted above into the housing 33 (see FIG. 7(B)), and the housing 33 is also provided with guides 39 therein for fixing the spout 32, to thereby establish such a structure that the guides 39 are engagedly inserted between the projection 37 and lower projection 38 of the spout 32, and the projecting rows 40 and the guides 39 cooperatively fix the spout 32 at a predetermined position of the housing 33 (see FIG. 7(A)).

However, there exists a deficiency in the fixing method for the spout 32 having such a structure, as follows.

Namely, there exist a variety of spout 32 such as having wide port or small port, and it is necessary to select one having a shape appropriate to the usage from such spouts. As such, there will be required a variety of housings adapted to the shapes of the variety of spouts, respectively, according to the aforementioned fitting and fixing method, so that the types of the spouts and housings are increased so much, resulting in inefficiency and in lost of economic effect that the package body is used instead of a PET bottle.

Further, if it is necessary to use a housing adapted to each shape of a spout, the number of types of housings is increased so much, resulting in inefficiency and in deviation from the purpose to decrease undesired wastes. It is desirable that the housing is adapted to a spout of any shape, and from both of economical viewpoint and that for decreasing wastes, it has been desired that the housing is adapted to every spout and the spout is used therefor.

It has been also desired for a spout to be welded to a bag-like package body in a more assured manner.

DISCLOSURE OF THE INVENTION

The present invention has been carried out in view of the conventional problems as described above, and it is therefore an object of the present invention to standardize a shape of a spout of a package body, and to provide a housing capable of accommodating a package body provided with a spout of any outer diameter and of allowing charging and discharging of the filler (such as soft drink and drinking water). It is also an object of the present invention to further ensure weldability of a spout to a package body.

To achieve the above object, the present invention provides a housing comprising: a casing, the casing comprising a cylindrical body, which cylindrical body is of an entirely longitudinally elongated and bottomed cylindrical shape, is openable into right and left halves about the vertical direction, and has an opening at a top portion of the cylindrical body in its closed state, the casing being adapted to accommodate therein a package body provided with a spout having a projected piece at an outer periphery of an upper portion of the spout, by arranging the spout in the casing in the closed state of the casing, with the spout being directed upwardly, and by then bringing the casing into its closed state, concave row grooves formed to be made continuous along a peripheral direction of an inner wall of the opening provided at an upper portion of the casing in the closed state of the casing, and a spout fixture, adapted to be divided into right and left halves in plan view, and forming a spout supporting hole vertically extending through the center of the spout fixture in a combined state of its halves, the spout supporting hole having a groove for fixing from the outside the projected piece of the spout of the package body accommodated within the casing, and the spout fixture having, at its outer peripheral portion, projecting rows formed to be made continuous in the combined state of the halves of the spout fixture, and the spout fixture being attachable to the opening of the casing.

Further, the present invention also provides a spout made of synthetic resin, having a body part provided with a through port opened upwardly and downwardly, a mouth portion of a bag-like package body entirely made of synthetic resin being welded to the lower portion of the body part to thereby seal the mouth portion, and filler within the package body being charged and discharged via the through port, the spout including a seat weldable to an inner surface of the package body at the lower portion of the body part, the seat having a weldable outer surface having a boat shape or rhombic shape in a plan view, and a projected piece at an upper periphery of the seat or at a periphery of the body part above the seat, the projected piece being projected outwardly.

BEST MODE FOR CARRYING OUT THE INVENTION

Figure 1A:
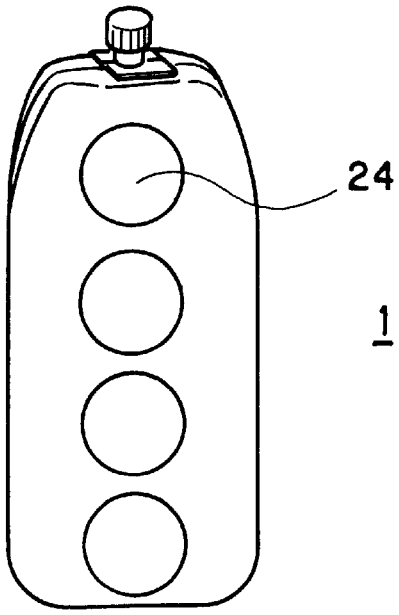
FIG. 1(A) is a front view of a housing in a closed state for accommodating a package body adopting a spout according to the present invention.
Figure 1B:
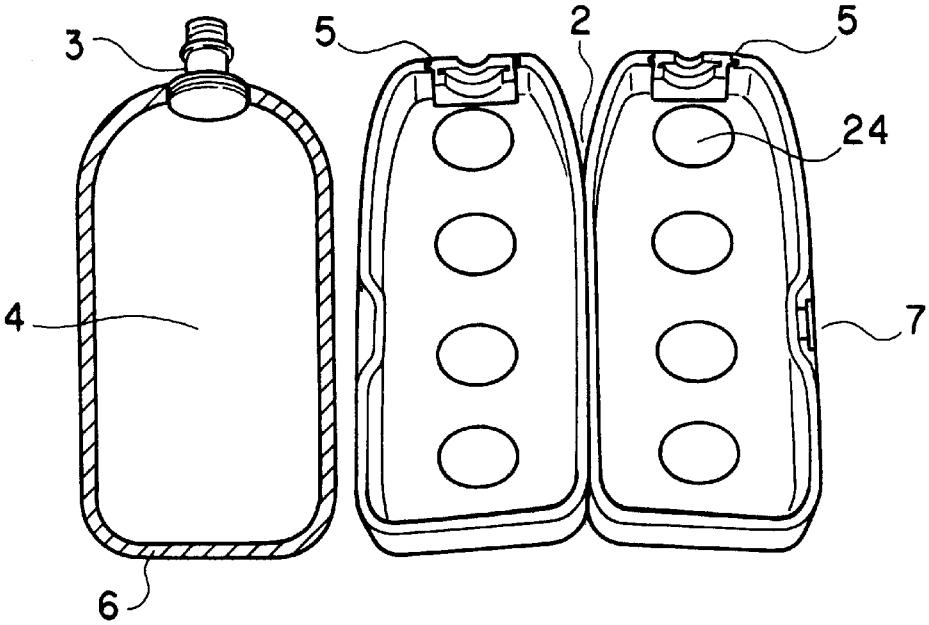
FIG. 1(B) is a front view of the housing in an opened state.

FIGS. 1 through 5 relate to the best mode for carrying out the present invention. Namely, the housing according to the embodiment for attaching a spout 3 according to the embodiment: comprises a casing 1 of a relatively flat, entirely longitudinally elongated and bottomed cylindrical shape. This casing 1 is made of a hard synthetic resin material such as polypropylene, and is openable into right and left halves about the vertical direction (see FIG. 1(B)) in which the halves are coupled to each other by a hinge 2 in a manner openable thereabout. The casing 1 is provided with a stopper 7, by which the casing 1 in a split or opened state is integrated into a wholly cylindrical shape (see FIG. 1(A)).

Figure 2:
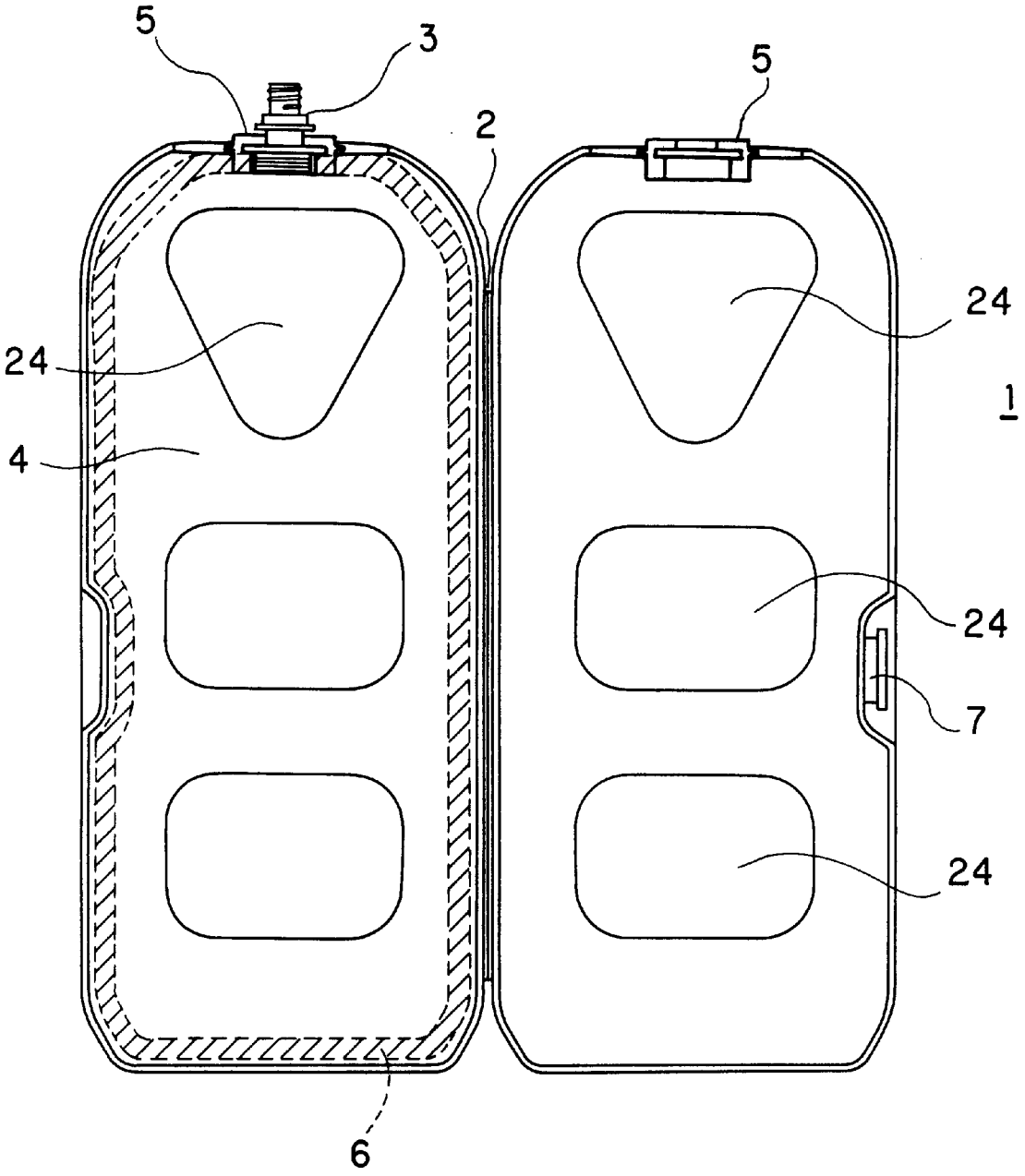
FIG. 2 is a front view of the housing in an opened state for fixing the spout.

The casing 1 has an upper opening to which the spout 3 according to the embodiment is attachable via spout fixture 5, so as to accommodate within the casing 1 a package body 4 filled with soft drink therein such as drinking water, with the spout 3 being directed upwardly (see FIG. 2).

The package body 4 is a bag-like container made of a soft synthetic resin such as polyethylene (PE), which is formed into a bag shape by a hollow cylindrical film or by two sheets of films made of soft synthetic resin the outer peripheries of which are welded by heat seal 6 to thereby form a bag shape. The spout 3 is attached in a sealed manner also via heat seal to an inner surface of an upper mouth portion 50 of the package body 4, thereby enabling, at the portion of spout 3, charging and discharging of soft drink such as drinking water filled in the package body 4 (see FIGS. 2 and 4).

Figure 4A:
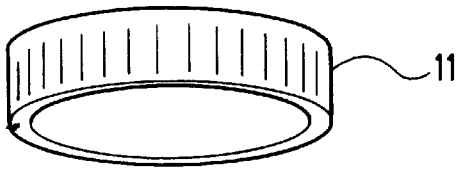
FIG. 4(A) is a perspective view of a cap to be threaded onto the spout.
Figure 4B:
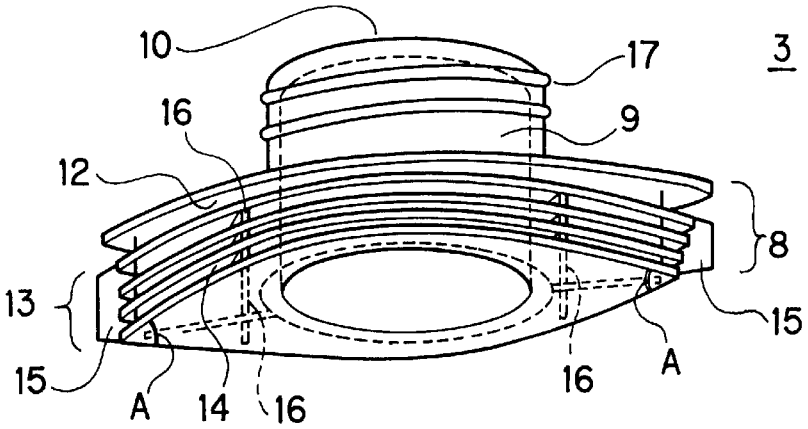
FIG. 4(B) is a perspective view of the spout according to the embodiment.

The spout 3 is manufactured of a hard synthetic resin such as polyethylene (PE), polypropylene (PP), and is provided with a body part 9 bored centrally and vertically as shown in FIG. 4. There is a seat 8 at the lower portion of the body part 9, and the seat 8 is provided with, at its upper periphery, a projected piece 12 projected outwardly. Namely, the spout 3 is adapted to conduct charging and discharging such as of drinking water filled in the package body 4, via port 10 which is closable by a cap 11.

The seat 8 has a curved outer surface for welding and forming a boat shape in a plan view having angles A of about 60° at right and left ends of the boat (see FIG. 4). The seat 8 is formed with, at the periphery of its upper end portion, the projected piece 12, which is formed of a flat plate having a thickness of about 1 mm and which has a similar boat shape in a plan view. Formed around an upper peripheral surface of the body part 9 of the spout 3 is a thread 17 for fitting to the cap 11. Why the seat 8 has a boat shape in a plan view is: to render the seat 8 to correspond to the mouth portion 50 of the package body 4 which has the relatively flat bag-like shape: and to increase a welding surface area to the mouth portion 50 as compared to a seat circular in a plan view, to thereby further ensure the welding.

Figure 5A:
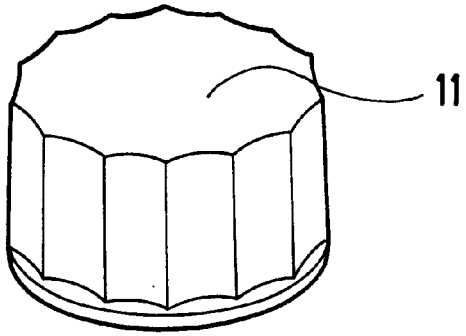
FIG. 5(A) is a perspective view of the cap to be threaded onto the spout, viewed from the above.
Figure 5B:
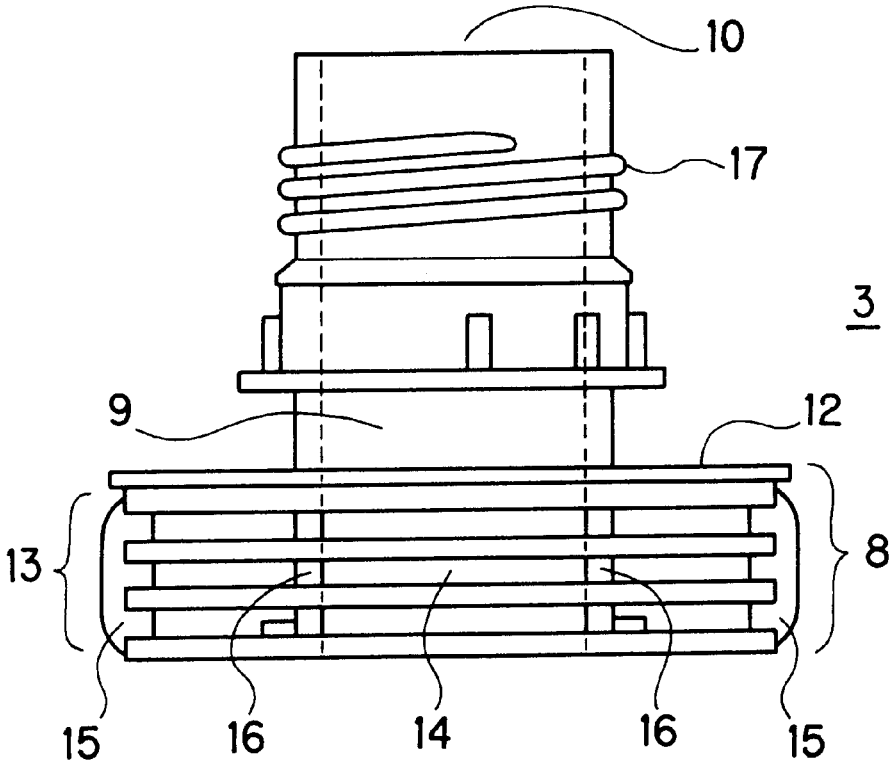
FIG. 5(B) is a front view of the spout according to the embodiment.
Figure 6:
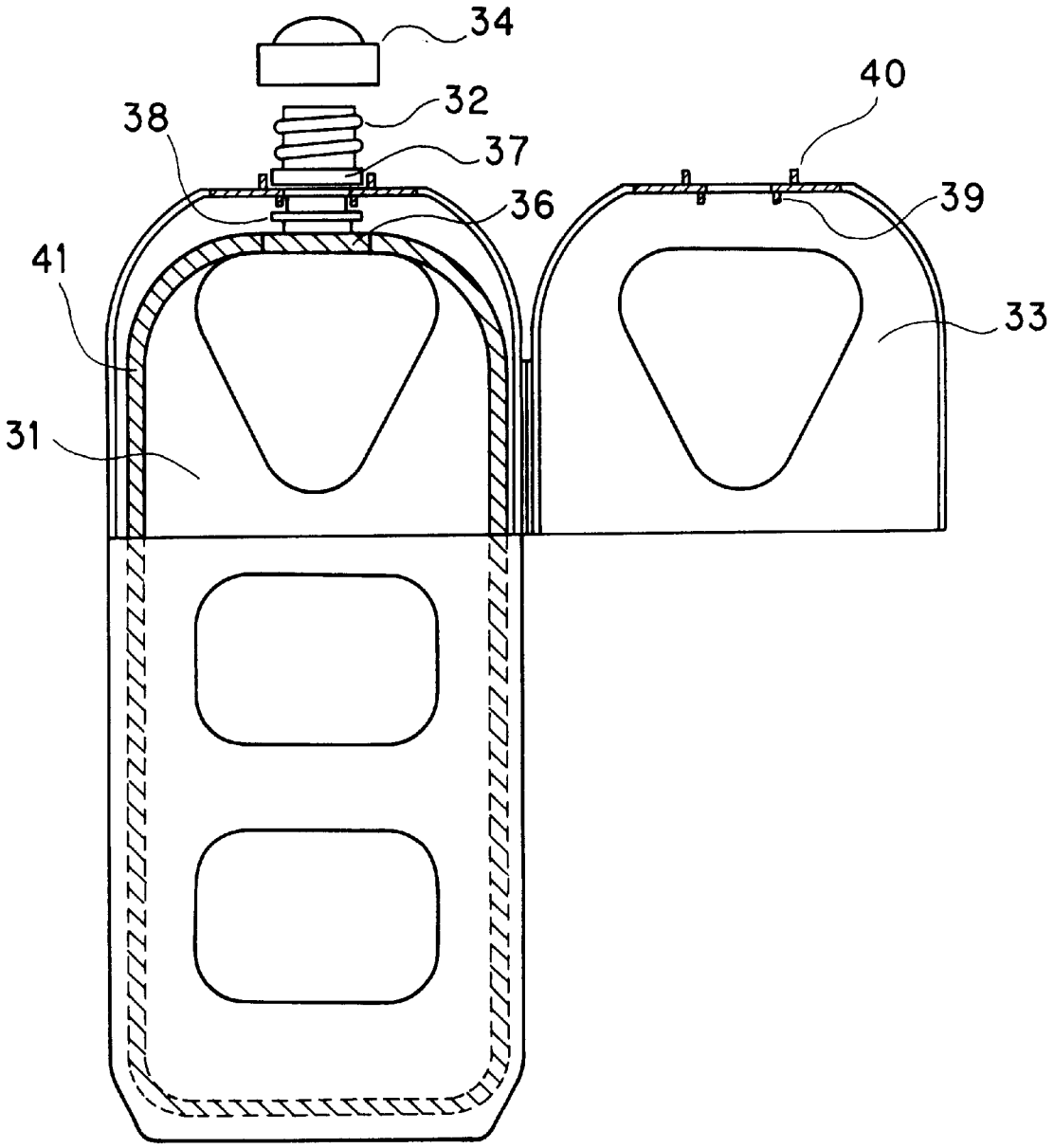
FIG. 6 is a front view of a conventional housing accommodating therein a package body having a spout.
Figure 7A:
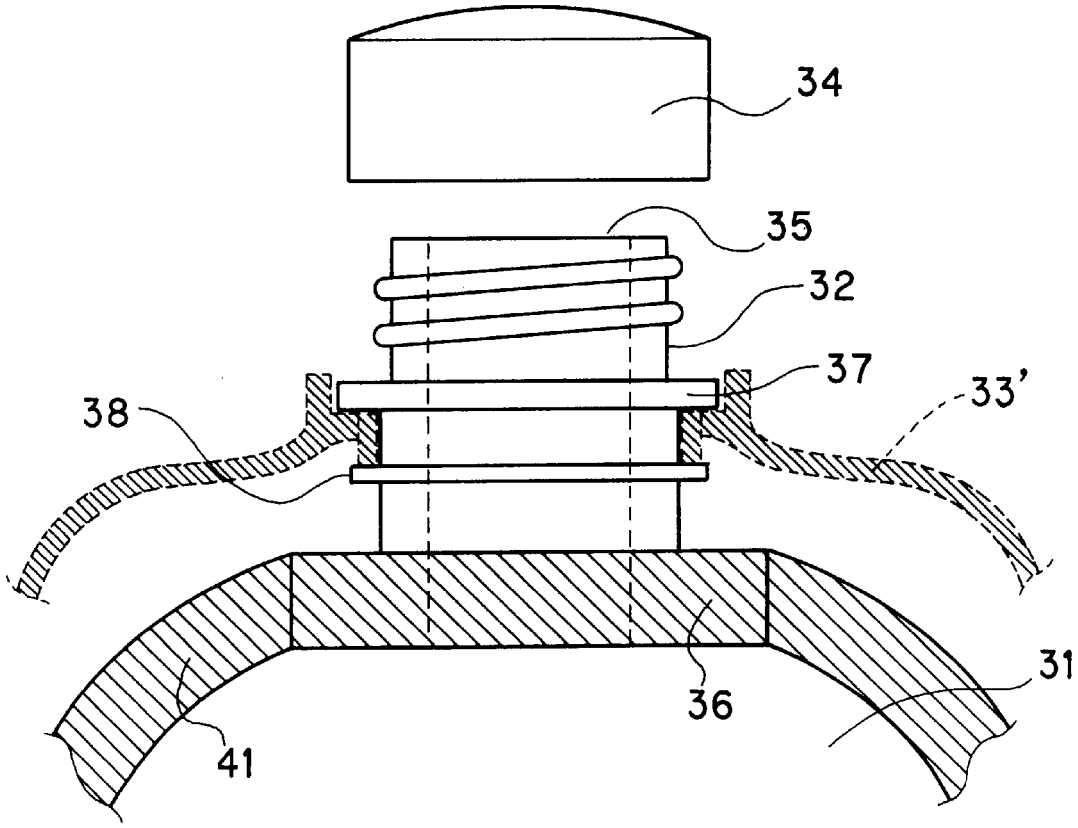
FIG. 7(A) is a front view of the conventional housing in a state for fixing the spout at an upper portion of the housing.
Figure 7B:
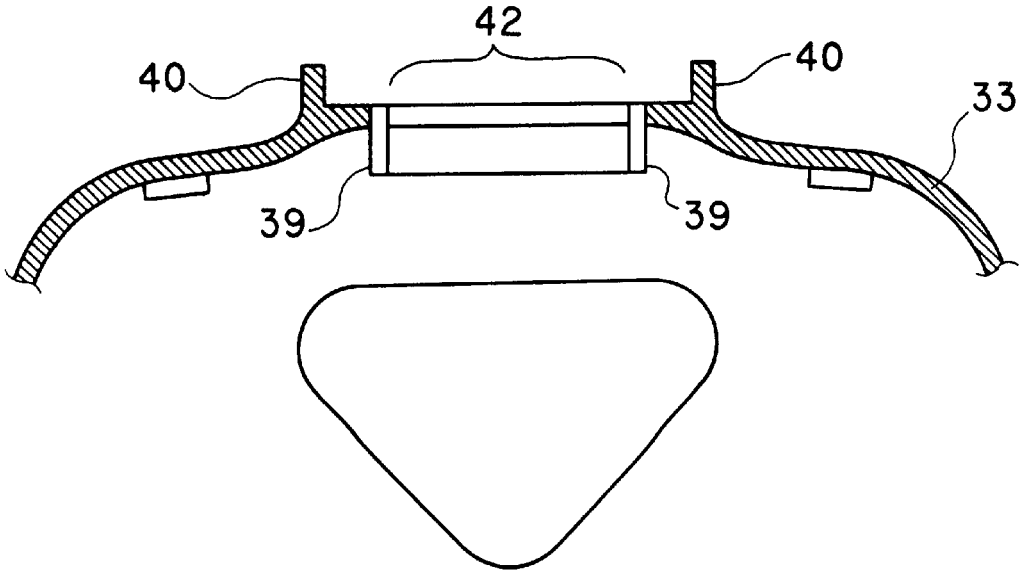
FIG. 7(B) is a front view of an upper portion of the housing.
Figure 8:
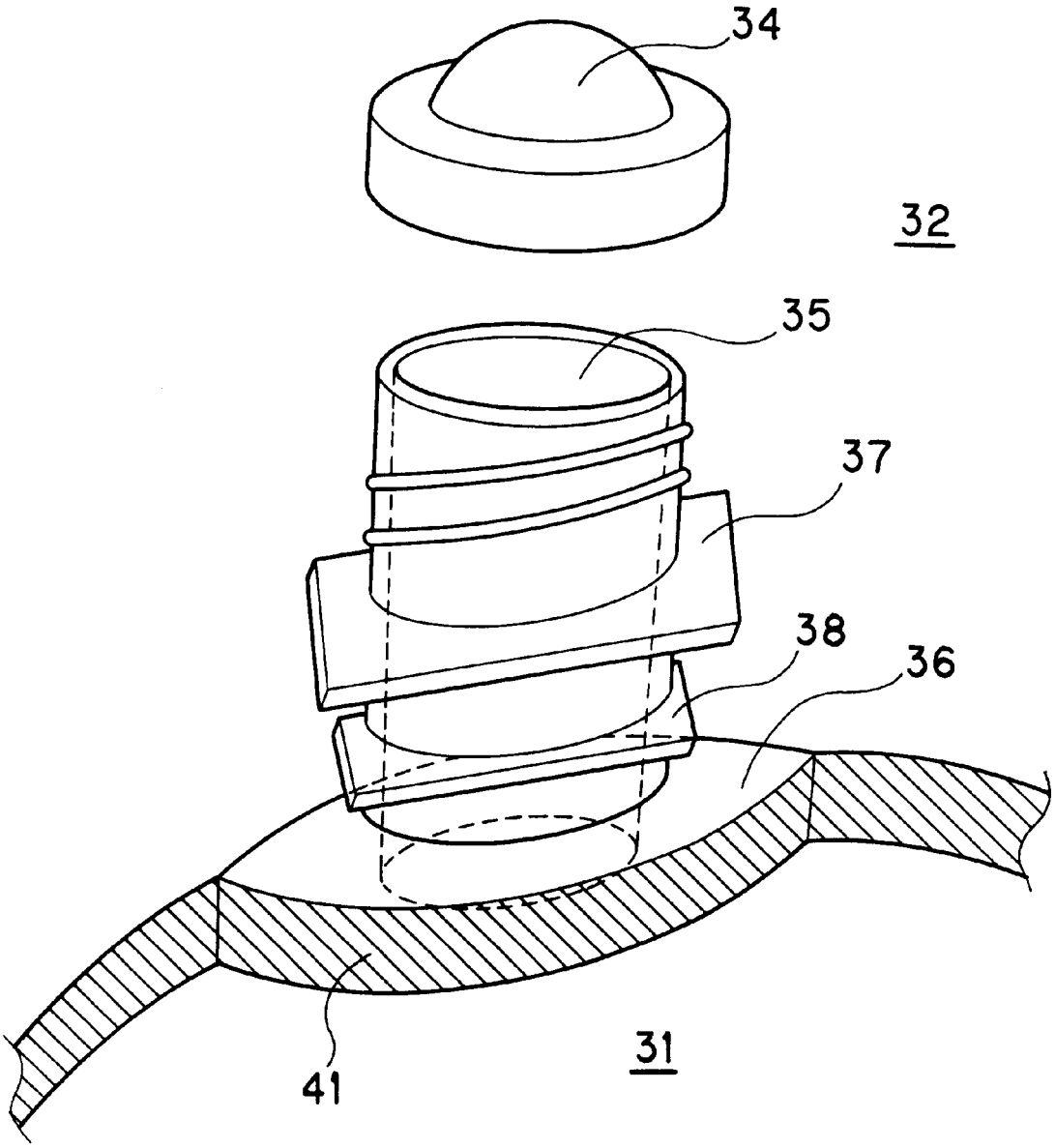
FIG. 8 is a perspective view of the conventional spout.

Provided below the projected piece 12 of the seat 8 having a boat shape in a plan view is a welding part 13 for the mouth portion of the package body 4 (see FIG. 5). This welding part 13 has a height of about 10 mm. The projected piece 12 projects outwardly, beyond this welding part 13 by about 1 mm, so as to fit into a groove 20 of the spout fixture 5 to thereby fix the spout 3 to the spout fixture 5.

The whole of outer periphery of the welding part 13 is welded to an inner surface of the mouth portion of the package body 4 by means of heat seal 6. To completely accomplish the welding, there are provided three steps of projecting ridges 14 along an outer periphery of the seat 8 under the projected piece 12 of the seat 8. Each of these projecting ridges 14 has a height of at least about 0.5 mm, and the peripheral or top portion thereof is melted and welded to an inner surface of the package body 4 at the time of heat welding, so that the water-tightness is further ensured by virtue of the three steps of projecting ridges 14.

To further ensure the welding, there are provided fin shaped portions 15 having a thickness of about 0.5 mm from the respective acute angled corners of the welding part 13 having a boat shape in a plan view, respectively, under the projected piece 12 of the seat 8. The fin shaped portions 15 project rightwardly and leftwardly, respectively, by a distance of about 1 mm like burr (see FIGS. 4 and 5), to thereby ensure the weldability between the welding part 13 having a boat shape in a plan view and the inner surface of the mouth portion of the package body 4.

The spout 3 has at its upper portion an opening of the through port 10 for soft drink such as drinking water charged in the package body 4, in which the size of the opening is adjustable to a wide one or a narrow one correspondingly to the usage.

Also the thickness of the body part 9 of the spout 3 can be adjusted to a variety of sizes depending on the usage, and the size of the seat 8 can be adjusted correspondingly thereto. However, it is preferable to constitute that the outer diameter of the seat 8 is increased in proportion to the thickness of the body part 9 such that the seat 8 and body part 9 are changed analogously to each other, except that: the projected piece 12 is projected from the seat 8 by about 1 mm, taking into consideration the relationship with the spout fixture 5 to be described later, to which the projected piece 12 is fixed; the height of the welding part 13 is about 10 mm; and the angles of both acute ends of the boat shape are set at about 60°.

Figure 4C:
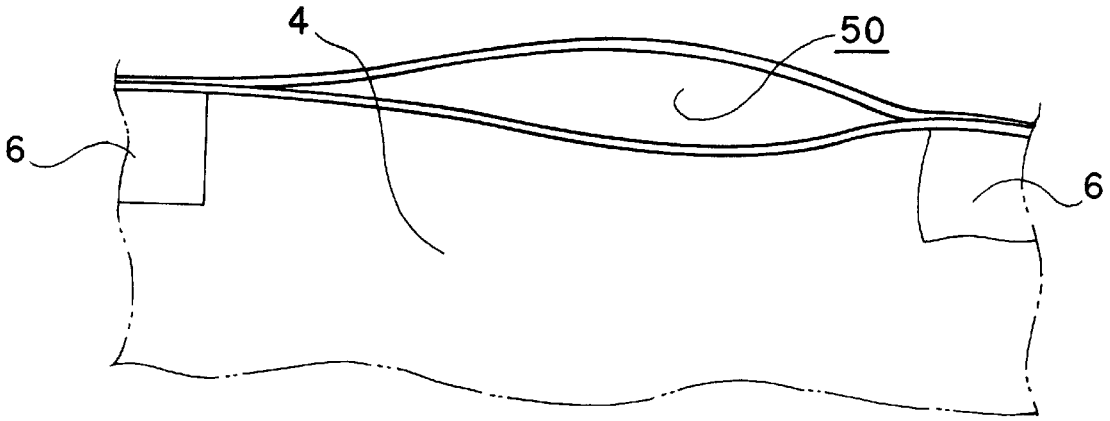
FIG. 4(C) is a perspective view of a mouth portion of the package body.

Further, although it is unnecessary in a small sized spout 3, it becomes advantageous in a large diameter spout 3 to set the height of the projecting ridge 14 higher at portions near the center of body part 9 than at portions near the acute ends of the boat shape in a plan view, to thereby enhance the weldability to the inner flat peripheral surface of the mouth portion 50 of the package body 4 shown in FIG. 4(C). Only, in this case, the projecting ridges 14 may tend to be deformed at the time of welding to the inner surface of the mouth portion of the package body 4. As such, there are formed a plurality of longitudinal ribs 16 which intersect the projecting ridges 14 so as to prevent such deformation noted above and to keep the distances between the projecting ridges 14. In this way, the seal for the inner surface of the mouth portion of the package body 4 becomes complete, so that leakage of the filler can be prevented.

The spout 3 integrated with the package body 4 is fixed to the opening portion of the casing 1 of the housing by means of the spout fixture 5. This spout fixture 5 has its outer configuration rectangular in plan view (see FIG. 3(A)), and can be divided into right and left halves in plan view. In a combined state of these halves, the spout fixture 5 has a plate-like upper surface, and there is formed a spout supporting hole 19 vertically through the central portion of the combined halves. In the combined state of the halves, the spout fixture 5 is formed with the groove 20 for fixing the projected piece 12 of the spout 3 from the outside, the groove 20 having a width of about 1 mm in the vertical direction beneath the spout supporting hole 19.

Formed at a lower portion just beneath the groove 20 at the spout supporting hole 19 is a curved surface 21 for abutting on the welding part 13 of spout 3 welded with the mouth portion of the package body 4, to thereby fix this lower portion. This curved surface 21 has a configuration substantially identical with the curved outer surface of the welding part 13 which has a boat shape in a plan view, and has a height of about 10 mm similarly to that of the welding part 13 in the embodiment. By providing such a curved surface 21, it becomes possible to fix the spout 3 in a stable manner by means of the spout fixture 5 without causing any deformation at the welding part between the package body 4 and spout 3, at the time of fixing the spout 3 to the spout fixture 5, so that damage of the package body 4 can be prevented.

According to such a fixing structure for the spout 3, there is obtained such an advantage that the dropping out of spout 3 can be avoided by virtue of engaged fitting between the projected piece 12 and groove 20, and the spout fixture 5 and spout 3 are strongly fixed to each other by conformity between the welding part 13 and curved surface 21. Although the spout fixture 5 is described to be divided into right and left halves, this does not necessarily mean that the halves are separated from each other, and rather the halves may be connected to each other such as by hinge.

Figure 3A:
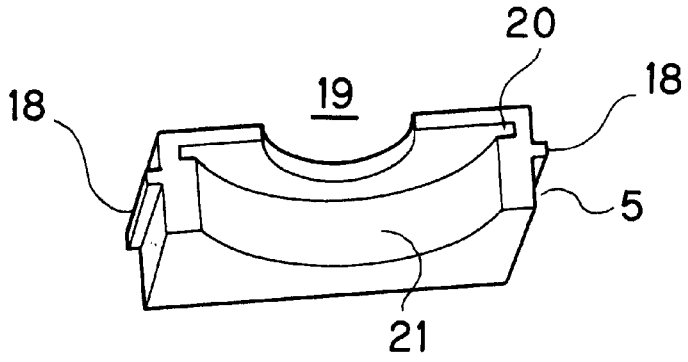
FIG. 3(A) is a perspective view of a spout fixture in a divided state.
Figure 3B:
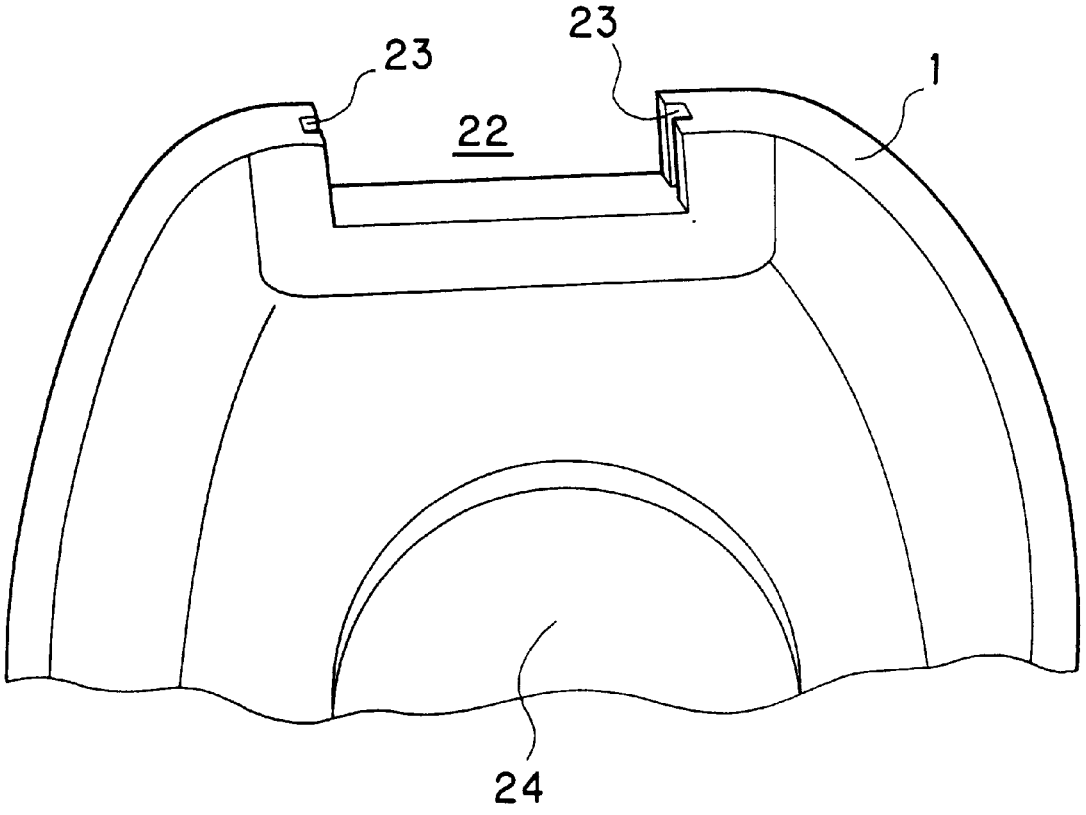
FIG. 3(B) is a perspective view of an opening portion of a casing of the housing.

Provided at the top of the casing 1 of the housing is an opening portion 22 rectangular in plan view, for fixing the spout fixture 5 (see FIG. 3). This opening portion 22 is defined in a closed state of the casing 1, and there are provided concave row grooves 23 each of which is made continuous along a peripheral direction of an inner wall of the opening portion 22 in the closed state of the casing 1 (see FIG. 3).

The spout fixture 5 in the combined state of its halves is provided with projecting rows 18 continuously extending in a horizontal direction, at the outer periphery of the spout fixture 5. By fitting these projecting rows 18 into the concave row grooves 23, respectively, it becomes possible to attach the spout fixture 5 fixed with the spout 3, to the upper opening of the casing 1. Namely, the package body 4 supported by the opening portion 22 via spout fixture 5 of spout 3 is located within the casing 1 in a state that the spout 3 is arranged at an upper side in the opened state of the casing 1 (see FIG. 2), and the package body 4 is stably accommodated within the casing 1 by closing the same.

The spout 3 and spout fixture 5 according to the embodiment are made of synthetic resin, so that they can be readily fabricated by injection molding making use of a metal mold. Such a metal mold is relatively small so that the fabrication cost of metal mold is not so expensive. Thus, by preparing only a metal mold of a size corresponding to that of a spout, there can be obtained a housing adapted to any size of spout standardized to a configuration of the embodiment, without changing the size of casing 1.

The housing provided with the spout fixture and the casing 1 thus can accommodate the projecting ridge 14 within the casing 1 in a stable manner, since the projected piece 12 of the spout 3 attached to the package body 4 filled with filler such as soft drink is fixed into the groove 20 of the spout fixture 5, and since the welding part 13 of the spout 3 having the curved outer surface having a boat shape in a plan view is fixed to the curved surface 21 of the spout fixture 5.

The package body 4 filled with filler is accommodated within the casing 1, and the casing 1 in its closed state is secured by the stopper 7 to establish the housing exhibiting a cylindrical shape as a whole. By detaching the cap 11 from the spout 3 when required, it is allowed to utilize from the exterior such as drinking water and soft drink filled within the package body 4, without disengaging the stopper 7 so as to open the casing 1.

When the filler such as soft drink within the package body 4 is exhausted, the casing 1 is opened to take out therefrom the package body 4. Then, the exhausted package body 4 is substituted by a new one so that the exhausted is discarded, or is refilled such as with soft drink. Thereafter, the aforementioned procedure is repeated to accommodate the package body 4 into the casing 1.

Concerning the casing 1 shown in FIGS. 1 and 2, there are provided window portions 24 having a circular shape in FIG. 1 or a rectangular shape and a triangular shape in FIG. 2, at the outer surface of the casing 1, so as to reduce the weight of the casing 1 and to observe the filled amount of the filler within the package body 4.

Embodiment

In the above embodiment, each of the seat 8 of the spout 3 and the projected piece 12 formed at the upper end of the seat 8 has a boat shape in a plan view. However, these parts may have a rhombic shape in plan view instead of a boat shape, such that the modified seat 8 has similar projecting ridges 14 and longitudinal ribs 16 and they are welded to the mouth portion 50 of the entirely flat package body 4 as shown in FIG. 4(C).

Further, in the above embodiment, the projected piece 12 is integrally formed with the seat 8 at the upper end portion thereof. However, separately from the seat 8, it is possible to form a projected piece at the body part 9 above the seat 8, and this projected piece is fitted into the groove 20 of the spout fixture 5.

Industrial Applicability

According to the present invention, there can be obtained such an advantage that only one type of housing is required, since the spout is attached to the housing via spout fixture which is adapted such as to an outer diameter of the spout. Thus, only one type of metal mold for injection molding is required for manufacturing the casing, when metal molds for spout and spout fixture are provided, so that the cost for fabricating metal mold is reduced.

Further, the housing can be used repeatedly, so that the amount of wastes can be also reduced, thereby considering the environment problem to which the social attention has been directed.

Moreover, the spout can be welded to the inner surface of the mouth portion of the package body, to thereby avoid leakage of the filler.

As a result, according to the present invention, there can be obtained such an effect to enable standardization of a shape of a spout in a package body, and effective provision of a housing which can accommodate a spout of any outer diameter and from the exterior of which a filler (such as soft drink and drinking water ) for the package body can be charged and discharged. There can be also obtained such an effect that the weldability of the spout to the package body is further ensured.

Although what has been described is at present considered to be the preferred embodiments of the present invention, it will be understood that the present invention may be embodied in other specific forms without departing from the spirit or essential characteristics thereof. The present embodiments are therefore to be considered in all respects as illustrative and not restrictive. The scope of the invention is indicated by the appended claims rather than by the foregoing description.

What is claimed is:

1. A housing comprising:

a casing, said casing comprising a cylindrical body, which cylindrical body is of an entirely longitudinally elongated and bottomed cylindrical shape, is openable into right and left halves about the vertical direction, and has an opening at a top portion of said cylindrical body in its closed state, said casing being adapted to accommodate therein a package body provided with a spout having a projected piece at an outer periphery of an upper portion of said spout, by arranging said spout in said casing in the closed state of said casing, with said spout being directed upwardly, and by then bringing said casing into its closed state, concave row grooves formed to be made continuous along a peripheral direction of an inner wall of said opening provided at an upper portion of said casing in the closed state of said casing, and a spout fixture, adapted to be divided into right and left halves in plan view, and forming a spout supporting hole vertically extending through the center of said spout fixture in a combined state of its halves, said spout supporting hole having a groove for fixing from the outside said projected piece of said spout of said package body accommodated within said casing, and said spout fixture having, at its outer peripheral portion, projecting rows formed to be made continuous in the combined state of the halves of said spout fixture, and said spout fixture being attachable to said opening of said casing.

2. A housing of claim 1, wherein a spout fixture, which corresponds to an outer diameter size of the spout of said package body to be accommodated within said casing and has a groove adapted to fix from the outside a projected piece of said spout of said outer diameter size, is selectively attachable to said opening of said casing.

* * * * *